US010625966B2

(12) United States Patent
Perini et al.

(10) Patent No.: US 10,625,966 B2
(45) Date of Patent: Apr. 21, 2020

(54) REWINDER FOR THE PRODUCTION OF PAPER LOGS

(71) Applicant: FUTURA S.p.A., Capannori (IT)

(72) Inventors: Fabio Perini, Viareggio (IT); Andrea Catalini, Porcari (IT); Manolo Tamagnini, Porcari (IT); Gabriele Betti, Capannori (IT)

(73) Assignee: FUTURA S.p.A., Capannori (IT)

( * ) Notice: Subject to any disclaimer, the term of this patent is extended or adjusted under 35 U.S.C. 154(b) by 295 days.

(21) Appl. No.: 15/737,484

(22) PCT Filed: May 27, 2016

(86) PCT No.: PCT/IT2016/000139

§ 371 (c)(1),
(2) Date: Dec. 18, 2017

(87) PCT Pub. No.: WO2016/203502

PCT Pub. Date: Dec. 22, 2016

(65) Prior Publication Data

US 2018/0179009 A1 Jun. 28, 2018

(30) Foreign Application Priority Data

Jun. 19, 2015 (IT) ..... UB2015A1541

(51) Int. Cl.
*B65H 19/22* (2006.01)
*B65H 18/02* (2006.01)
*B65H 23/00* (2006.01)

(52) U.S. Cl.
CPC ..... *B65H 19/2269* (2013.01); *B65H 18/023* (2013.01); *B65H 23/00* (2013.01); *B65H 2511/14* (2013.01); *B65H 2511/142* (2013.01)

(58) Field of Classification Search
CPC .... B65H 9/2269; B65H 23/00; B65H 18/023; B65H 2511/14; B65H 2511/142
See application file for complete search history.

(56) References Cited

U.S. PATENT DOCUMENTS 5,769,352 A 6/1998 Biagiotti
7,338,005 B2 * 3/2008 Biagiotti ..... B65H 19/2269 242/532.3

(Continued)

FOREIGN PATENT DOCUMENTS

EP 1519886 B1 4/2006
WO 2010004521 A1 1/2010

OTHER PUBLICATIONS

International Search Report dated Oct. 12, 2016 of corresponding International Application No. PCT/IT2016/000139 (3 pages).

(Continued)

*Primary Examiner* — William A. Rivera
(74) *Attorney, Agent, or Firm* — Maier & Maier, PLLC

(57) ABSTRACT

Rewinder for the production of logs. A feeding element adapted to supply a paper web. A guide element adapted to guide sequentially several cores along a predetermined path between a station for feeding the cores and a winding station in which a predetermined amount of the web is wound on each core. A winding element adapted to wind the paper web on the cores in the winding station. The guide element includes a guide with a curved end section that ends in the winding station and in cooperation with the winding element, delimits a channel crossed by each core before reaching the winding station.

7 Claims, 13 Drawing Sheets

(56) References Cited

U.S. PATENT DOCUMENTS

| | | | | |
|---|---|---|---|---|
| 7,802,748 | B2 * | 9/2010 | De Matteis | B65H 19/2269<br>242/526.1 |
| 8,011,612 | B2 * | 9/2011 | Gelli | B65H 19/2269<br>242/532.2 |
| 8,215,086 | B2 * | 7/2012 | Maddaleni | B65H 19/29<br>53/118 |
| 9,809,417 | B2 * | 11/2017 | Mellin | B65H 75/243 |
| 2009/0095836 | A1 * | 4/2009 | Maddaleni | B65H 19/2269<br>242/526 |
| 2017/0137249 | A1 * | 5/2017 | Perini | B65H 19/2269 |

OTHER PUBLICATIONS

PCT Written Opinion dated Oct. 12, 2016 of corresponding International Application No. PCT/IT2016/000139 (5 pages).

* cited by examiner

REWINDER FOR THE PRODUCTION OF PAPER LOGS

FIELD

The present invention relates to a rewinder for the production of paper logs.

BACKGROUND

It is known that the production of paper logs, from which are obtained, for example, rolls of toilet paper or rolls of kitchen paper, involves the feeding of a web of paper, formed by one or more superimposed plies, along a predetermined path where several operations are performed before the formation of the logs, including a transverse pre-incision of the paper web to form the pre-cut lines which divide it into separable sheets. The production of paper logs implies the use of cardboard tubes, commonly said "cores" on whose surface a predetermined amount of glue is distributed to enable the bonding of paper web on the cores introduced into the machine that produces logs, commonly said "rewinder". The glue is distributed on the cores when they pass along a corresponding path comprising an end part that is commonly called "cradle" for its concave conformation. The formation of logs implies, also, the use of winding rollers downstream of the cradle, which make each core to rotate about its longitudinal axis thus causing the winding of the web on the core. The process ends when a predetermined number of sheets is wound on the core, with the gluing of an edge of the last sheet on the underlying one of the roll thus formed (so-called "edge-closing" operation). At this point, the log is discharged from the rewinder.

EP1519886 discloses a rewinding machine performing the operations described above.

A drawback connected with the use of conventional rewinders resides in the fact that the paper web at an initial stage of winding on the core, given the fixed position of the winding rollers, forms a series of narrower windings. Therefore, the finished log features zones that are more compact compared to other zones of the same log, determined by said configuration of the machine, in which zones the winding density in the radial direction is greater, and less compressed areas, in which the winding density is lower. Therefore, the appearance of the finished product is not optimal and there is also a higher consumption of paper when the end of the process is determined by the achievement of a predetermined diameter of the log. In this context, the winding density can be defined as the number of sheets counted along a radial direction of the log divided by the radial length of the zone where the winding density is measured. To overcome the aforementioned drawback, rewinders have been produced in the past having a mobile winding roller that allows a better control of the first layers of paper wound on the core. However, such a solution is still improvable because at a certain point of the mobile winding roller movement, i.e. when the log being formed reaches a given diameter, the latter, with the further movement of the mobile winder roller, interferes with the end part of the cradle and is subject to damages leading to the breaking of the paper web and, therefore, to the machine stop.

A rewinder having elastic means adapted to allow a modification of the shape of the end part of the guide defining the path followed by the cores is disclosed in WO2010/004521.

SUMMARY

The main purpose of the present invention is to reduce the above-mentioned drawbacks.

Another object of the present invention is to provide a more effective guide of the cores along their path inside the rewinder such that the cores are not subject to slippage and therefore to loss of the predetermined reciprocal position of the glue points when the cores reach the winding station.

This result has been achieved, in accordance with the present invention, by means of a rewinder having the features indicated in claim 1. Other features of the present invention are object of the dependent claims.

Thanks to the present invention, it is possible to produce better quality paper logs, in which the distribution of the paper in the radial direction is more uniform. Furthermore, it is possible to ensure a lower consumption of paper when the log formation process ends at the achievement of a predetermined diameter and the appearance of the finished product is better. In addition, the guide of the cores inside the rewinder is improved.

These and other advantages and features of the present invention will be best understood by anyone skilled in the art thanks to the following description and to the attached drawings, provided by way of example but not to be considered in a limitative sense, wherein:

BRIEF DESCRIPTION

FIG. 1 schematically shows a rewinder (RW) in accordance with the present invention;

FIGS. 2-5 schematically show different stages of the process of formation of a log within the rewinder and the path followed by the cores, in accordance with a first embodiment of the invention;

FIGS. 6-8 schematically represent different stages of the process of formation of a log within the rewinder and the path followed by the cores, in accordance with a further embodiment of the invention;

Figure 1:
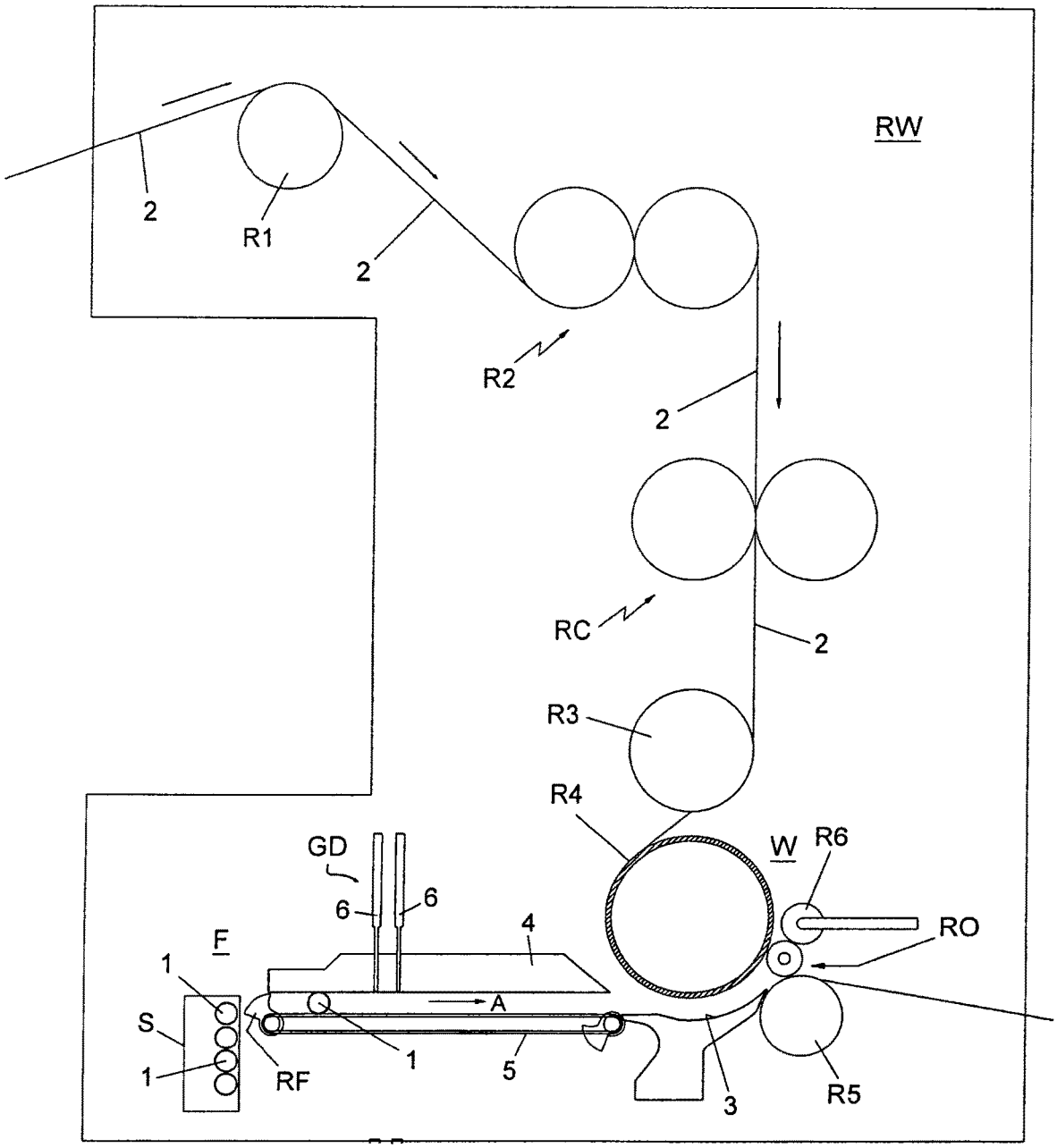
Figure 2:
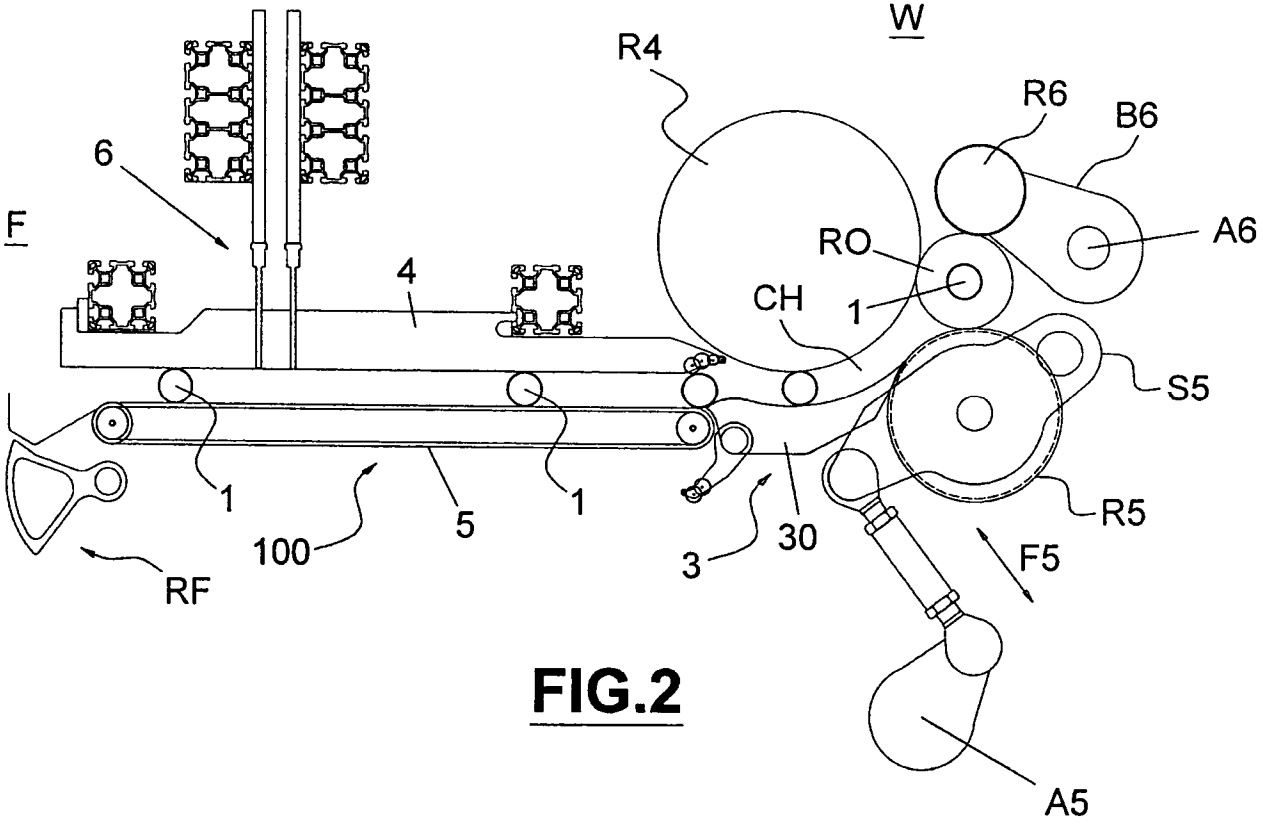
Figure 3:
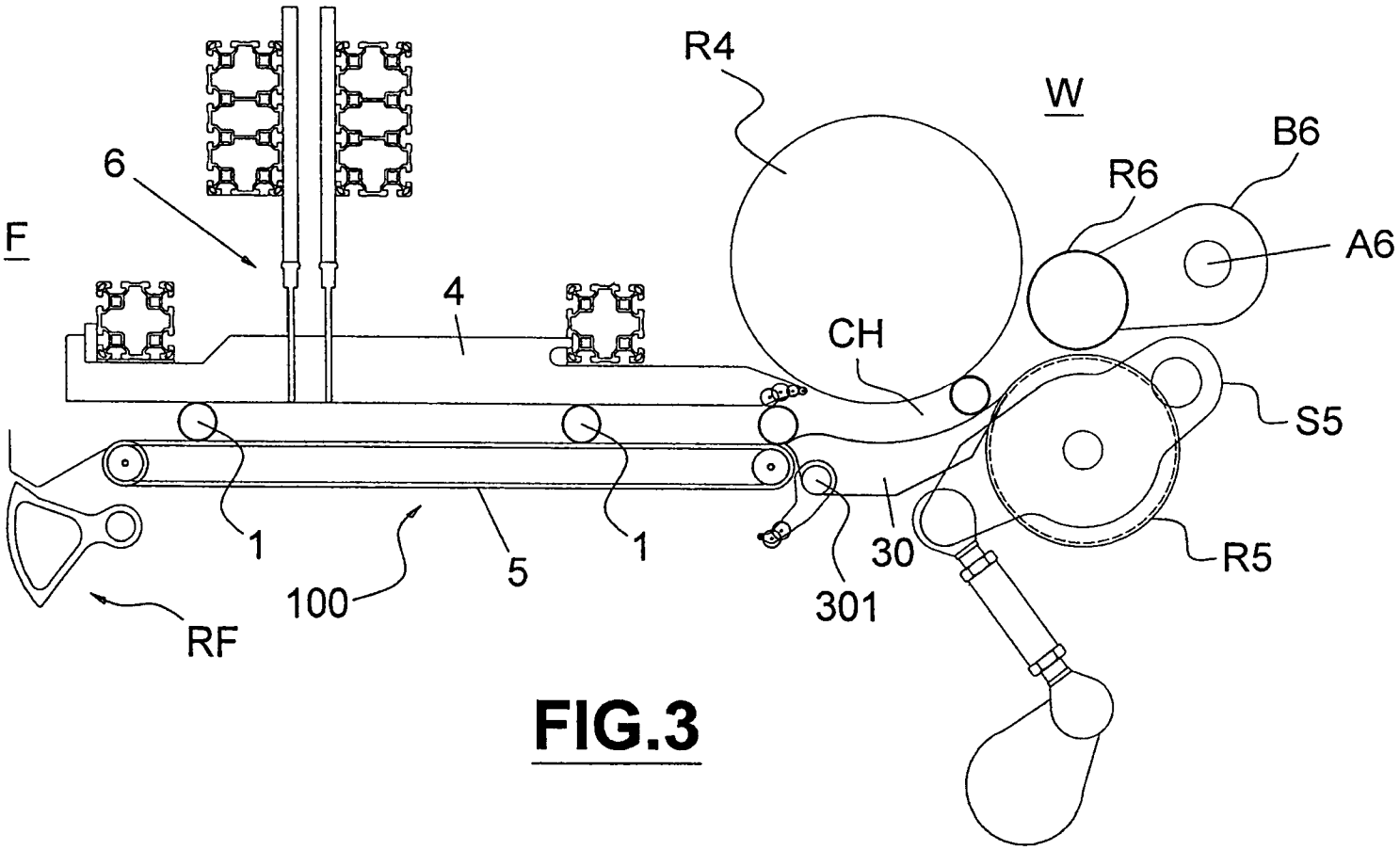
Figure 4:
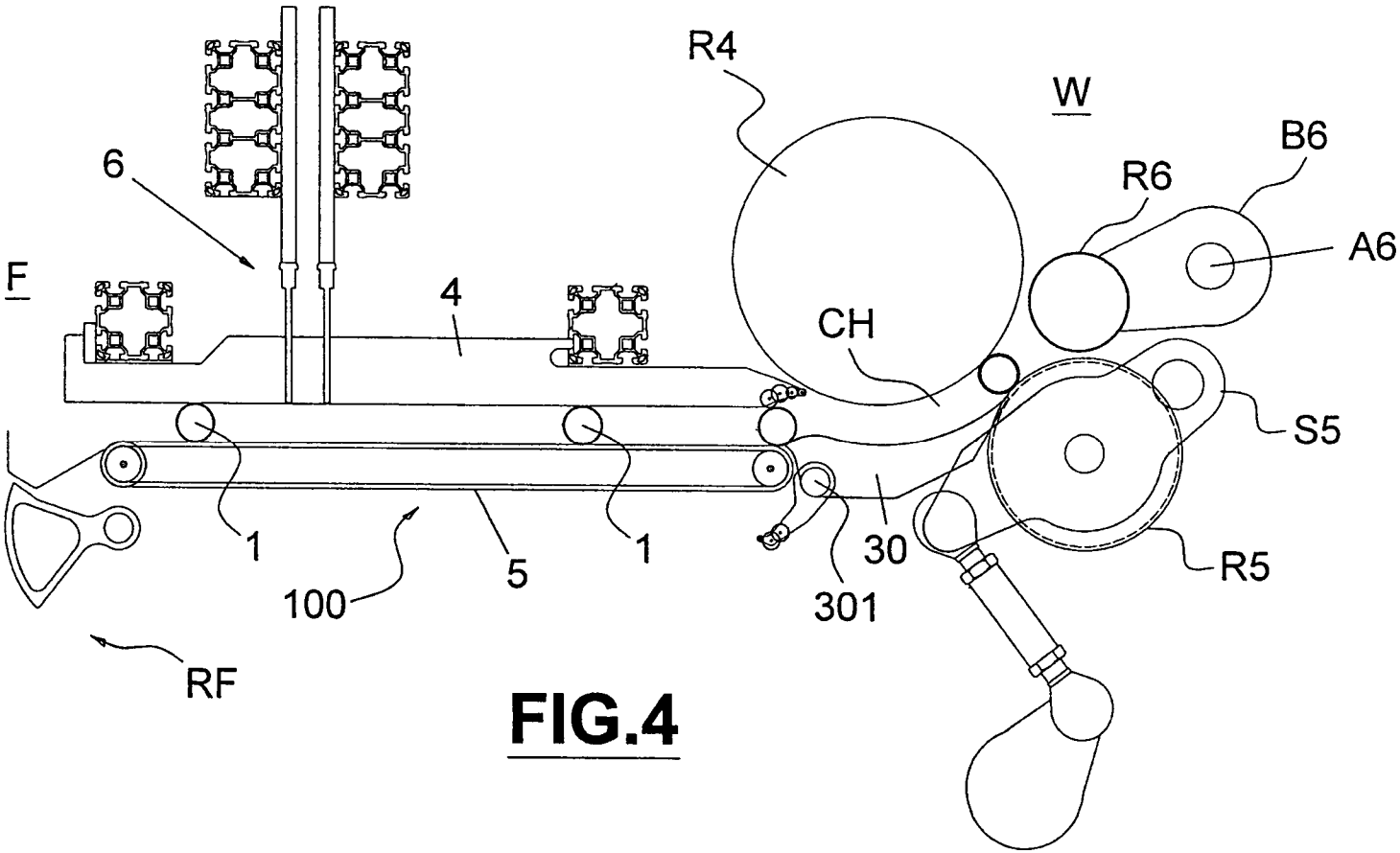
Figure 5:
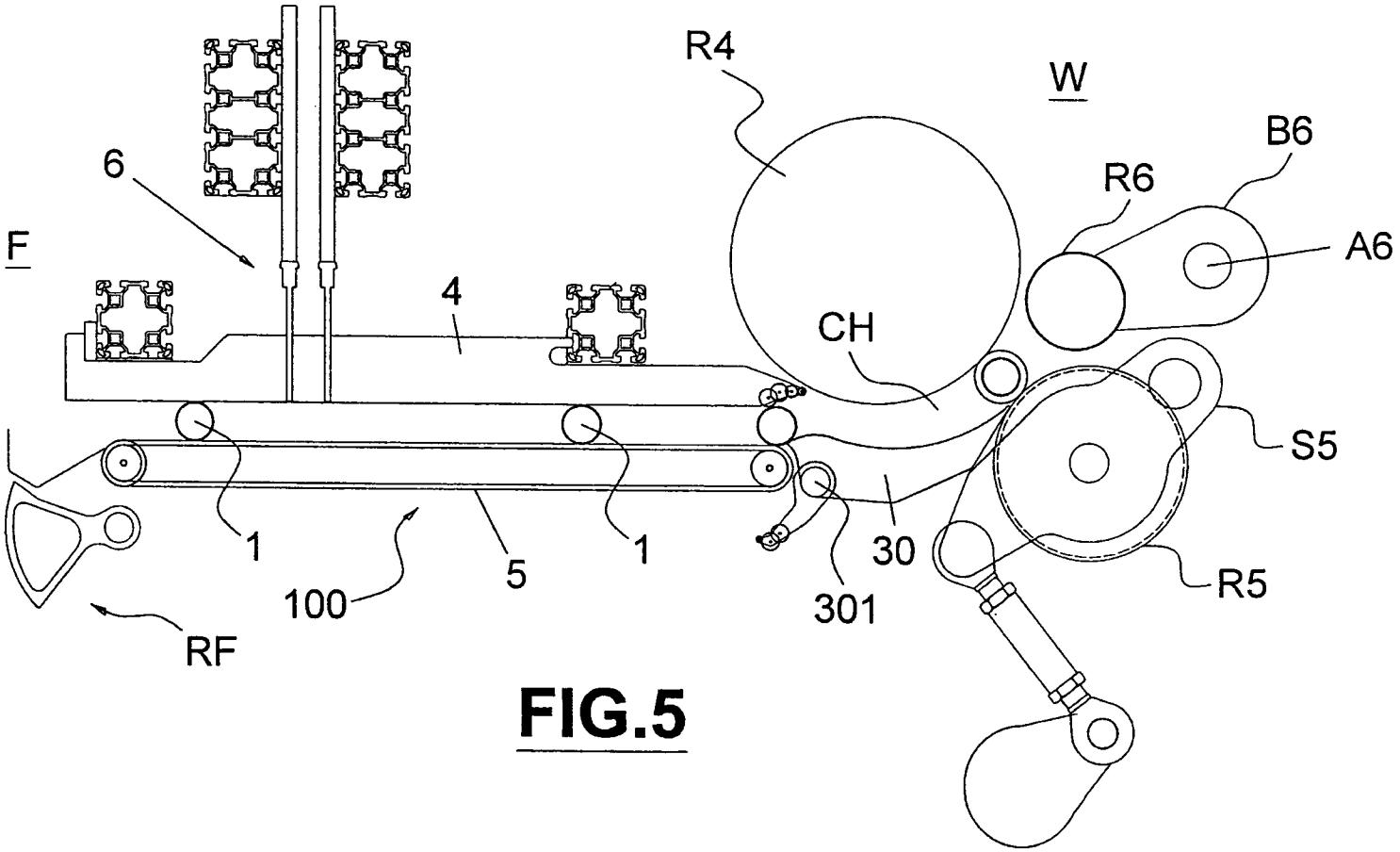
Figure 14:
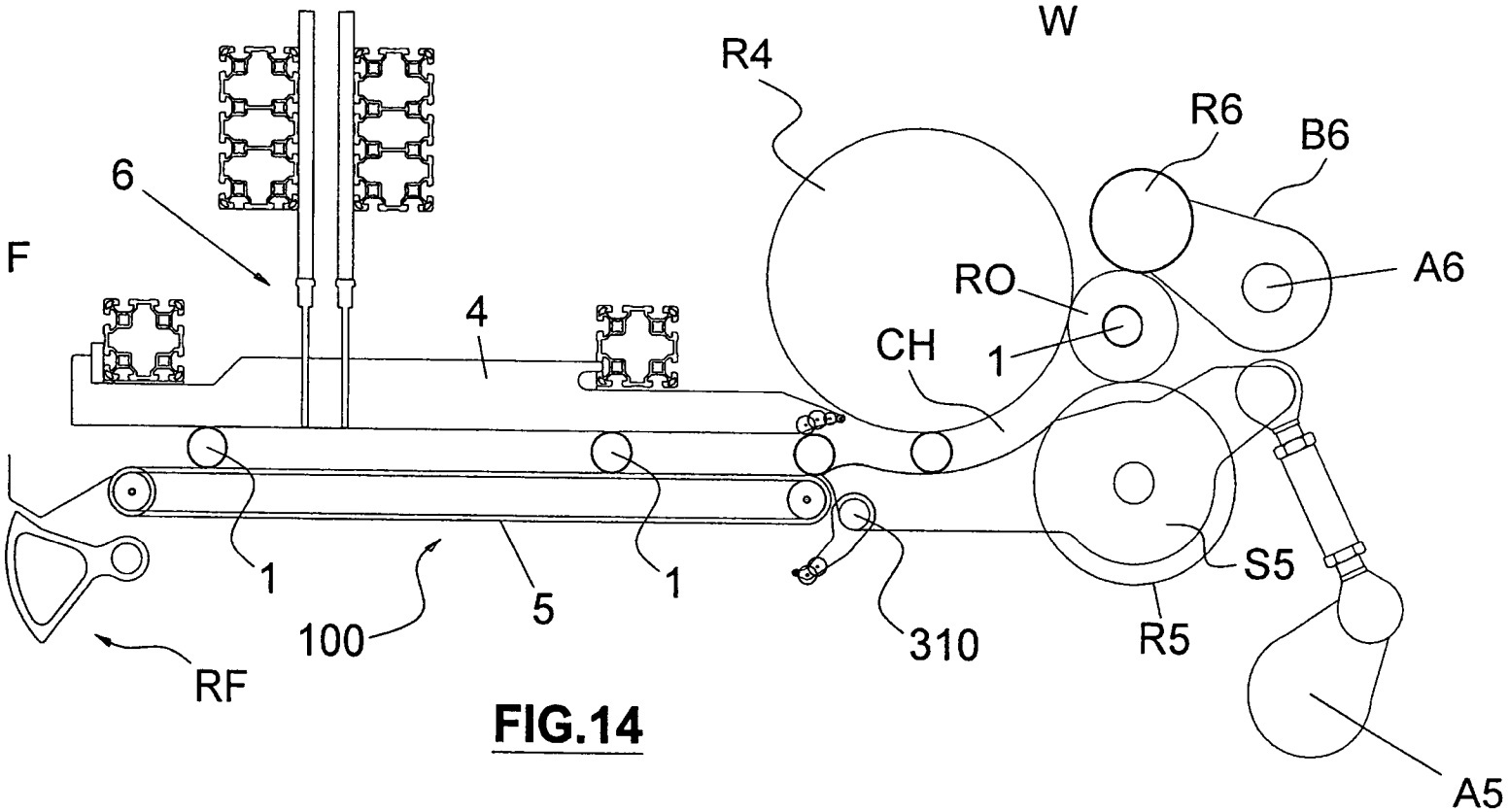

FIG. 14 schematically shows an alternative embodiment of the device shown FIG. 2.

DETAILED DESCRIPTION

Reduced to its basic structure and with reference to the drawings, a rewinding machine or rewinder (RW) in accordance with the present invention is of the type comprising:

- a core feeding station (F) for feeding the cores (1) supplied by an accumulator (S), in which there is a rotating feeder (RF) that picks up a core (1) at a time and introduces it in a guide along which there is a sizing device (GD) comprising a series of glue dispensers (6);
- means for feeding and transversally pre-cut a paper web (2) formed by one or more superimposed plies, with a series of feeding rollers (R1, R2, R3) and pre-cut rollers (RC) arranged along a feeding and pre-cut path for the paper web (2);
- means for winding the paper web (2) on a core (1) in a winding station (W) of the rewinder, with a first winding roller (R4) located downstream of said feeding and pre-cut rollers (R1, R2, R3, RC), and two additional winding rolls (R5, R6) positioned and acting downstream of the first winding roller (R4) with respect to the direction followed by the cores (1) and the paper web (2): the second and the third winding roller (R5, R6) are arranged downstream of a curved section (3) of a guide that, in cooperation with the first winding roller (R4), delimits a cradle-shaped channel (CH) downstream of the sizing device (GD); said channel (CH) is crossed in sequence by the cores (1) on which the sizing device (GD) distributes a predetermined quantity of glue and delimits an inlet passage for the cores (1) moving towards the winding station (W).

The first winding roller (R4) has also the function of guiding the paper web (2) coming from the feeding and pre-cut guide rollers located upstream with respect to the direction followed by the paper web (2).

The second roller (R5) is below the third roller (R6) of the winding station (W) and, for this reason, from here on it will be also referred to as "lower winding roll". The lower winding roller (R5) is mounted on a corresponding support (S5) that allows to move it away from the first roller (R4) while the diameter of the log (RO) under formation in the winding station (W) gradually increases. For this purpose, the support (S5) is connected with an actuator (A5) that determines its movement, as indicated by the arrow "F5", from and towards the first roller (R4). The actuator (A5) is in turn connected with a control unit, known per se and not visible in the drawings, which controls it and which consequently determines the position of the support (S5) during the formation of the log (RO). The winding roller (R6), positioned above the lower winding roller (R5), is mounted on the end of an arm (B6) connected to an actuator (A6) that allows to bring it closer to the channel (CH) and respectively to move it away in function of the instantaneous diameter of the log (RO) under formation. The actuator (A6) is also connected to the aforementioned control unit. The system formed by the winding rollers (R4, R5, R6), the support (S5), the actuators (A5, A6) and the unit controlling these actuators, is known to those skilled in the art. The step of removal of a finished log (RO) from the winding station (W) and the step of initiating the formation of a new log in the same winding station (W) are also known.

The aforesaid channel (CH) delimits the last section of the path followed by the paper web (2) and the cores (1) before entering the winding station (W). On the cores (1) is applied a predetermined amount of glue intended to make the paper web (2) glued to the same cores (1), according to methods known to those skilled in the art, while the cores (1) advance along a predetermined direction (A), defined by the rectilinear guide section (100) served by the feeder (FR), to reach the channel (CH). For example, said rectilinear section (100) is formed by a set of motorized belts (5) closed in a loop on pulleys (50) whose axis is horizontal and perpendicular to the aforementioned advancement direction (A), and by a corresponding series of fixed plates (4) having a prevailing longitudinal extension (a prevailing length with respect to the thickness and height). The fixed plates (4) are positioned above the belts (5). The motorized belts (5) engage the cores (1), coming from the feeding station (F), forcing them to roll upstream of said channel (CH). The sizing device (GD) comprises two series of dispensers (6) sequentially placed between the plates (4). The dispensers (6) distribute the glue, from above, on the cores (1) along the path defined by the guide section (100). Therefore, on each core (1) crossing the guide (100) is applied a predetermined amount of glue on two different points (G1, G2) serving, as known to those skilled in the art, to obtain the glueing of the last sheet of a log in formation into the winding station (W) with the underlying sheet of the same log and respectively the glueing of the first sheet of a new log on a corresponding core (1).

The curvilinear section (3) has the shape of a cradle, is arranged downstream of the rectilinear section (100) and is formed by a series of plates (30) arranged side by side and longitudinally aligned with the belts (5), such that a rear side (300) of each plate (30) is approached to the a corresponding belt (5).

The rear side (300) of the plates (30) is mounted on a shaft (301) whose axis is horizontal and parallel to the axes of the aforementioned rollers (R4, R5, R6) of the winding station. The rear side (300) of the plates (30) is mechanically connected with the support (S5) of the lower winding roller (R5). Therefore, when the support (S5) of the lower winding roller (R5) is lowered, the plates (30) rotate about the axis (x-x) of the shaft (301) such that the front side (302) of each plate follows the roller (R5) and does not stay in its initial position. Consequently, the log (RO) under formation in the winding in the station (W) does not interfere with the front side (302) of the plates (30), that is, with the front side of the cradle, and is subject to a practically constant pressure from the start to the end of the winding process. Then, the paper web wound on the core (1) in station (W) is more uniformly distributed, without giving rise to more compacted zones and less compacted zones. It is noted the front side of plates (30) is the side facing the lower winding roller (R5).

In the following, the curved section (3) of the guide is also indicated as the cradle (3).

Figure 9:
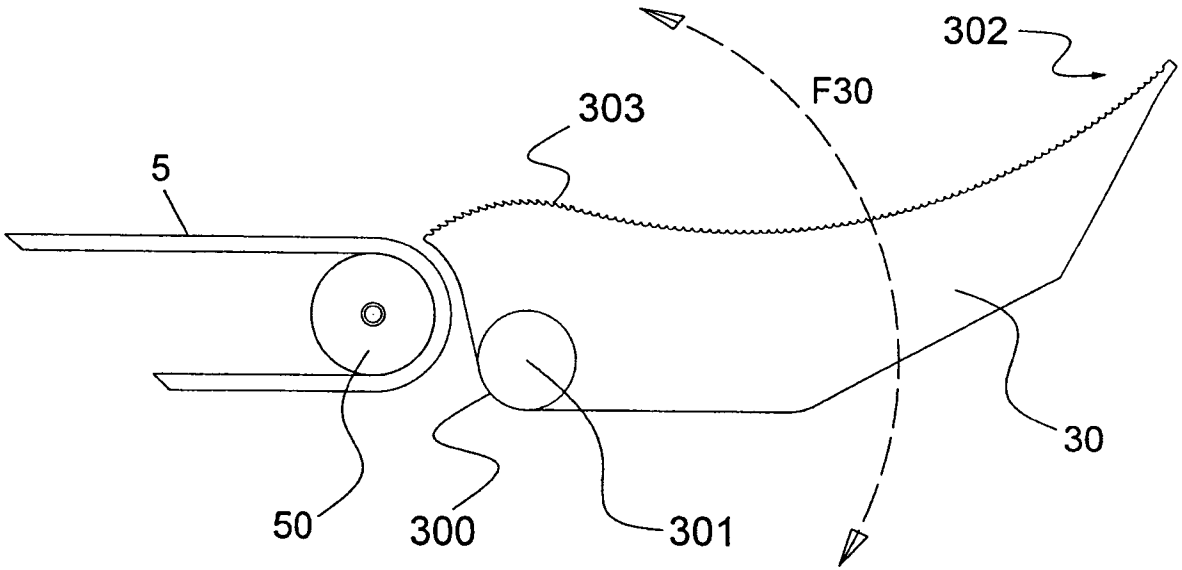
FIGS. 9 and 10 are two enlarged details of FIG. 6.

In FIG. 9 the rotation of the plates (30) is indicated by the arrow "F30".

In practice, the controlled rotation of the plates (30) determines a controlled variation of the geometry, i.e. shape and dimensions, of the channel (CH) in the vicinity of roller (R5). In fact, due to said controlled rotation, the channel (CH) is enlarged near the roller (R5) where, once started the formation of the new log, the latter can benefit of a larger space without interfering with the front side of the plates (30).

It is understood that the controlled movement of the plates (30) can also be obtained by means of an independent actuator. In this case, the previously mentioned mechanical connection between the plates (30) and the support (S5) is not foreseen.

Figure 6:
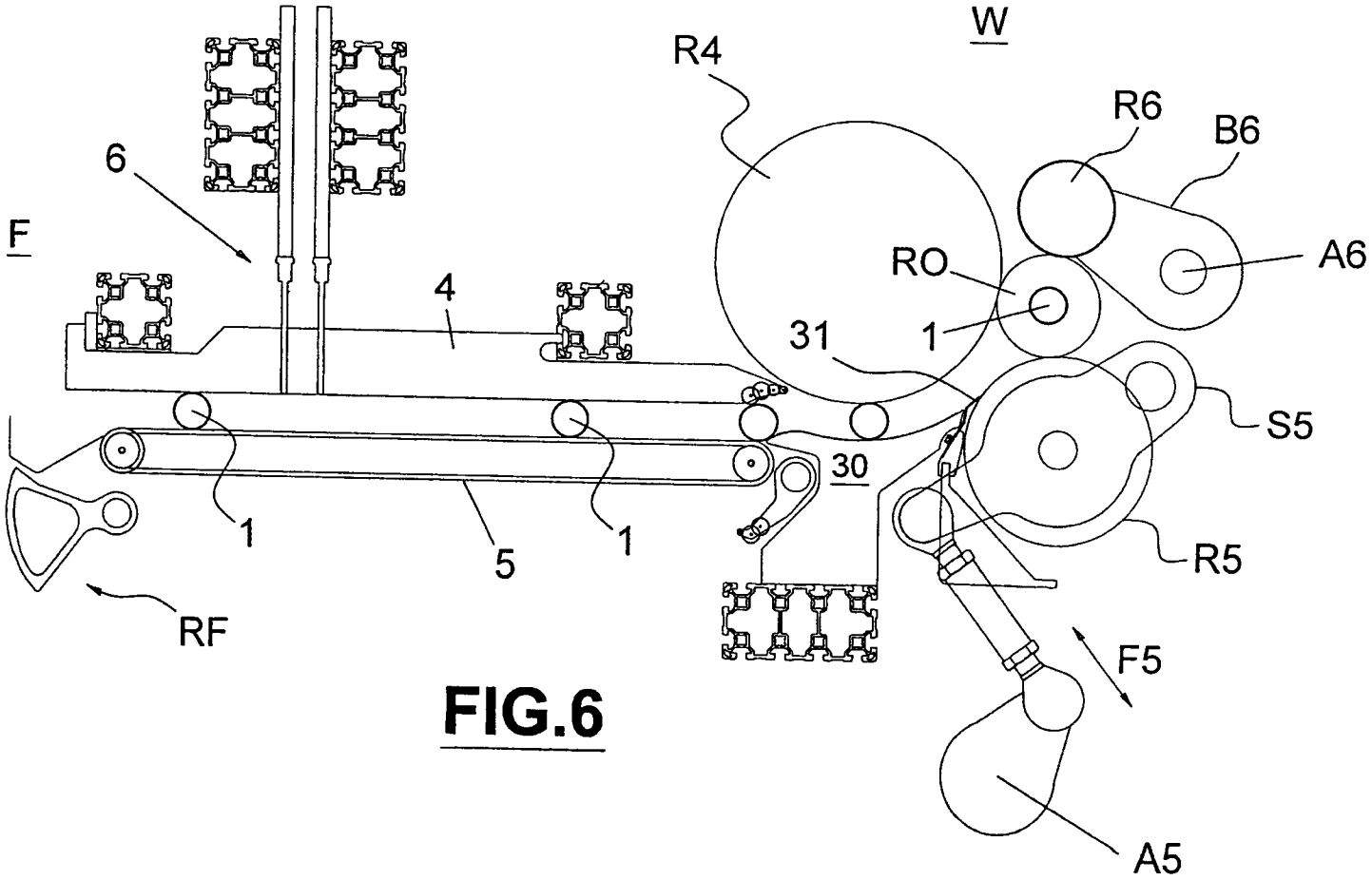
Figure 7:
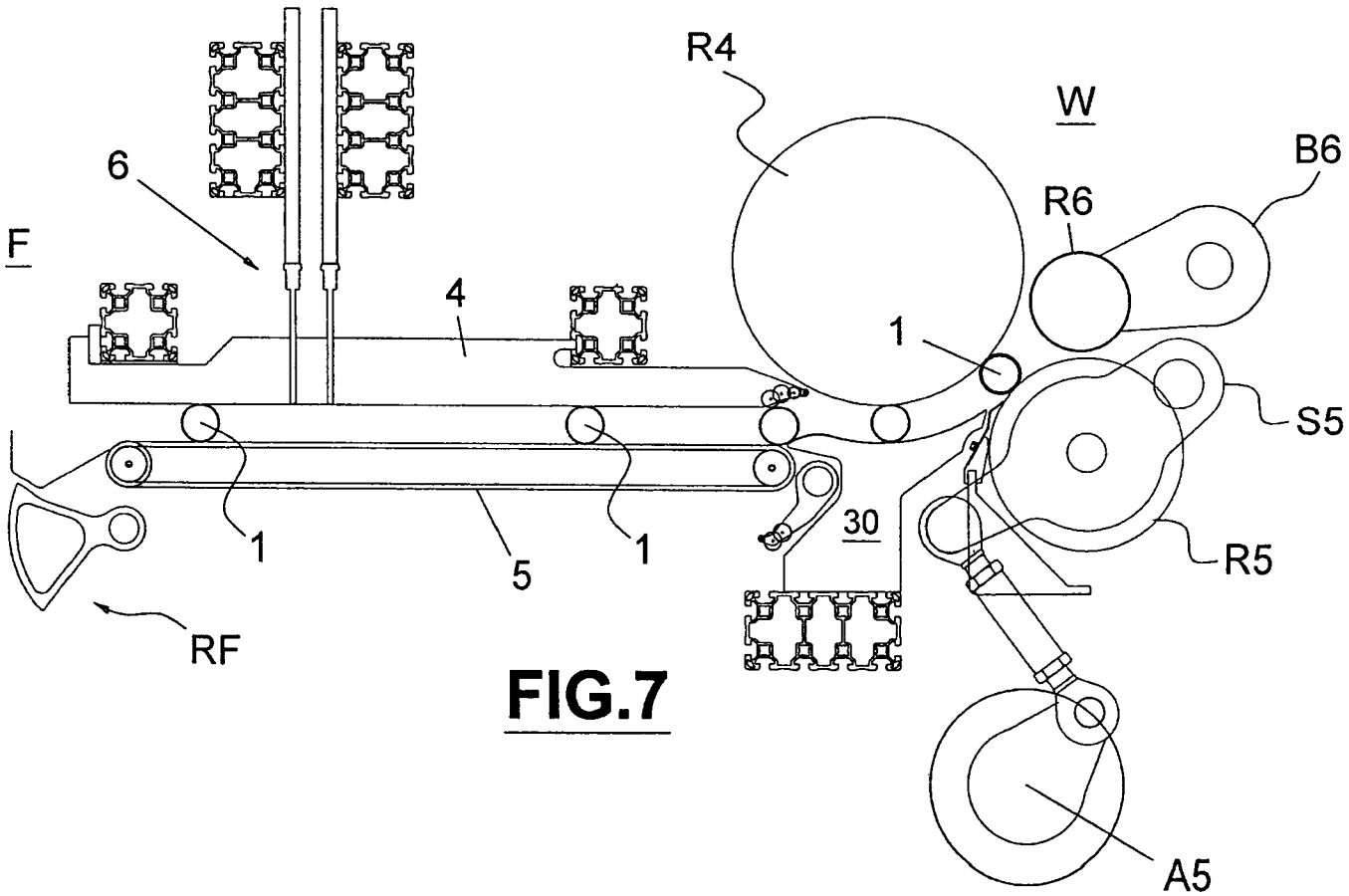
Figure 8:
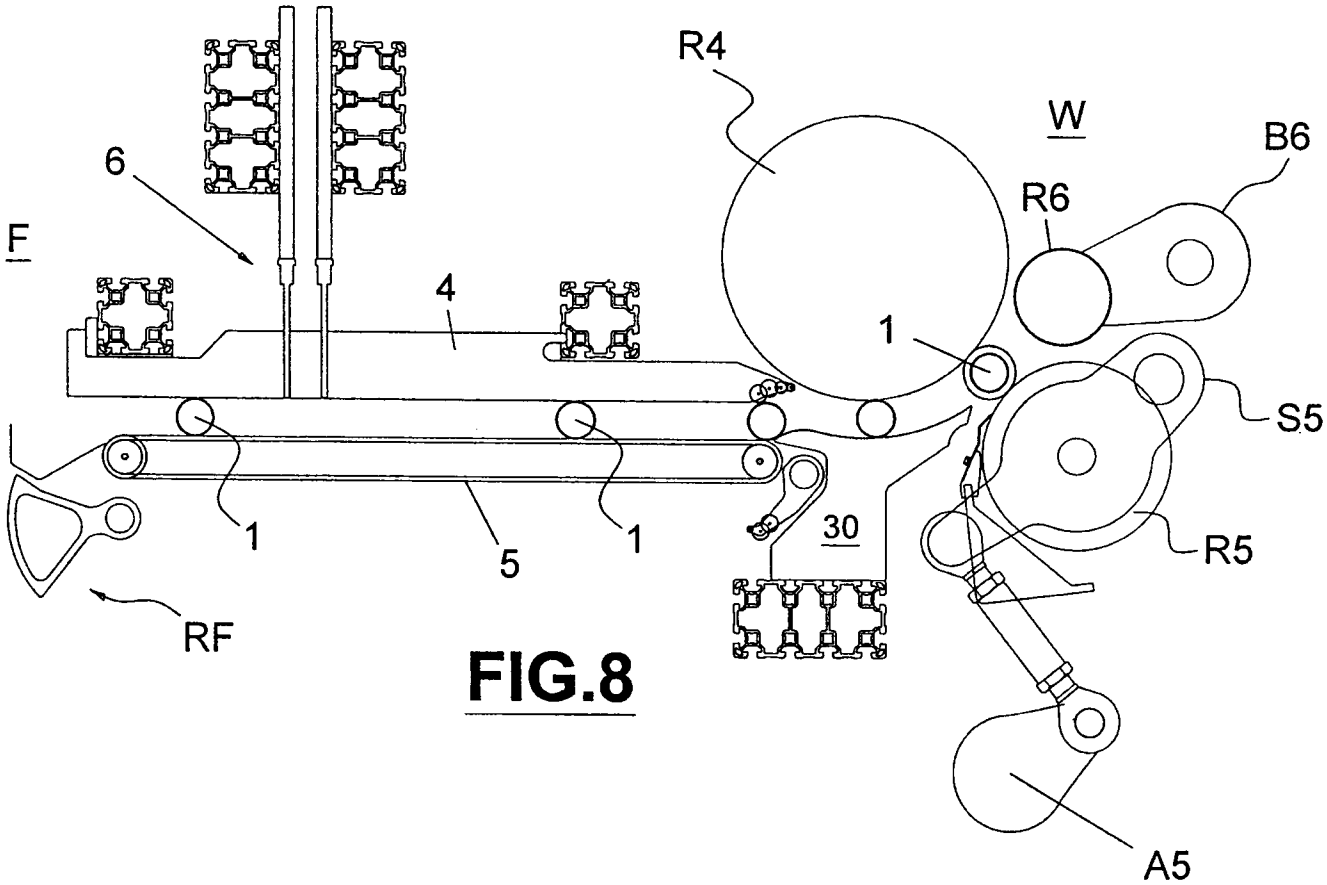

FIGS. 6-8 show a further embodiment of the present invention.

More particularly, the lower side of the channel (CH) is again formed by a series of plates (30) arranged side by side and longitudinally aligned with the belts (5), in such a way that the rear side (300) of each plate (30) is approached to the front part of a corresponding belt (5). In this case, however, the plates (30) are fixed and a further plate (31) is arranged between each fixed plate and the lower winding roller (R5), such that each further plate forms an extension of the respective plate (30) that, in turn, is rigidly connected to the support (S5). In other words, the cradle-shaped guide section (3) has a fixed part (formed by the plates 30) and a part (formed by the extensions 31) that moves synchronously with the support (S5) of the lower winding roller (R5). By connecting the rear part (310) of the extensions (31) with the support (S5), there is provided a device that ensures a particularly simple synchronism between the movement of the support (S5) and the movement of the extensions (31), since it is sufficient to control the actuator (A5) only. Preferably, the rear parts (310) of said extension (31) are mounted on a common support (S31) which extends parallel to the axis of the lower winding roller (R5) and which is fixed to the support (S5) of the latter. Even in this case, a change will occur in the shape and dimensions of the channel (CH) near the roller (R5) with the advantages previously described.

It is understood, however, that said extensions (31) can be moved by an independent actuator.

With reference to the example shown in FIG. 14, the support of the lower winding roller (R5) extends on its rear side forming the cradle (3) that is rearwardly pivoted on the shaft (301) and, on its front side, is connected with the actuator (A5), whereby, when the actuator (A5) is activated, both the cradle (3) and the roller (R5) rotate about the axis of shaft (310). In this example, the actuator (A5) controls both the movement of roller (R5) and the geometry of the cradle (3).

With reference to all the examples described above, the cores (1) are guided along a path defined by a guide comprising a curved end section (3) adapted to delimit a concave channel (CH) in cooperation with an overlying roller (R4) which, in turn, guides the paper web (2) and cooperates with a further roller (R5) to wind the same web on the cores (1) crossing the channel (CH), and said curved end section (3) comprises a portion (30; 31) that moves synchronously with said further roller (R5) under the control of an actuator controlling said synchronous movement while the paper web is wound on the cores (1) thus changing the shape and the dimensions of the channel (CH) in the vicinity of the further roller (R5).

More generally, a rewinder according to the present invention comprises supply means, adapted to supply a paper web (2), guide means for guiding several cores (1) sequentially along a predetermined path between a station (F) for feeding the cores (1) and a winding station (W) in which a predetermined amount of said web (2) is wound on each core (1), winding means (R4, R5, R6) adapted to wind the paper web (2) on the cores (1) in the winding station (W), wherein said guide means comprise a guide having a curved end section (3) that ends in the winding station (W) and that, in cooperation with the winding means, delimits a channel (CH) crossed by each core (1) before reaching the winding station (W); and, advantageously, the rewinder comprises means adapted to control a cyclic change of the geometry of the end section of the guide (3) while the winding means carry out the winding of the web (2) on the cores (1) so that, cyclically, the height of an end part of the channel (CH) varies between a predetermined minimum value (h1) and a predetermined maximum value (h2).

Figure 13:
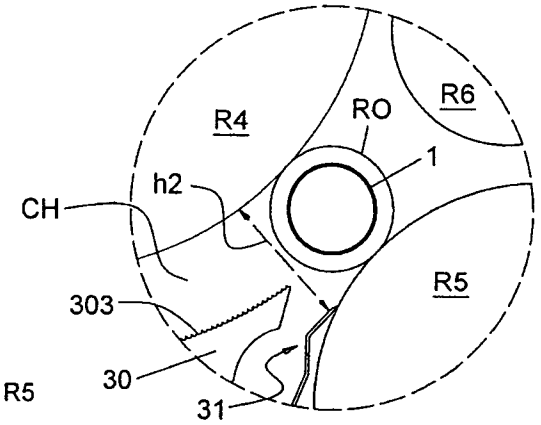
FIG. 13 is a detail of FIG. 8.
Figure 12:
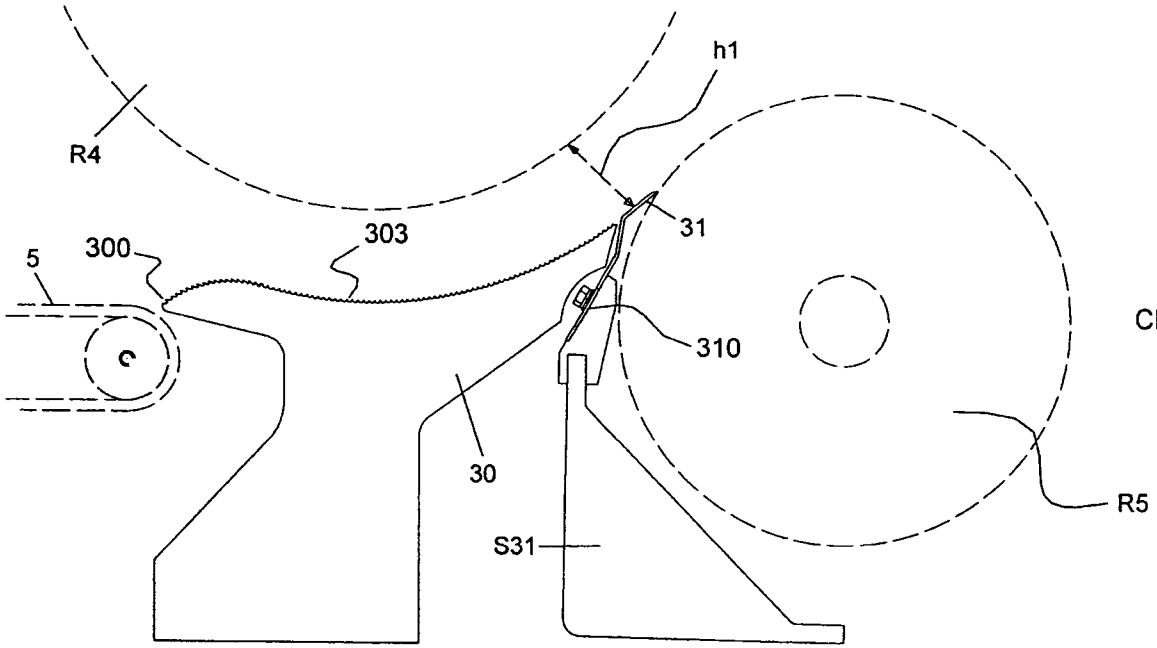
FIG. 12 is a detail of FIG. 6.

As illustrated in FIG. 12 and FIG. 13, said height is measured, for example, in a radial direction with respect to the roller (R4).

According to another aspect of the invention, said guide comprises a rectilinear section (100) upstream of the curved section (3).

In another aspect of the invention, described above with reference to the example shown in FIGS. 2-5, a rear side of the curved section (3) of said guide is connected to rotation means controlling its cyclic rotation about a horizontal axis (x-x), the angular amplitude of said rotation being predetermined; and said curved section (3) is formed by a plurality of elements (30) each of which is connected to said rotation means and is provided with a rear part (300) mounted on a rotation shaft oriented along said axis (x-x).

In accordance with a further embodiment of the invention, an end or front side of said curved section (3) is formed by movable extensions (31) associated with fixed elements (30).

Figure 10:
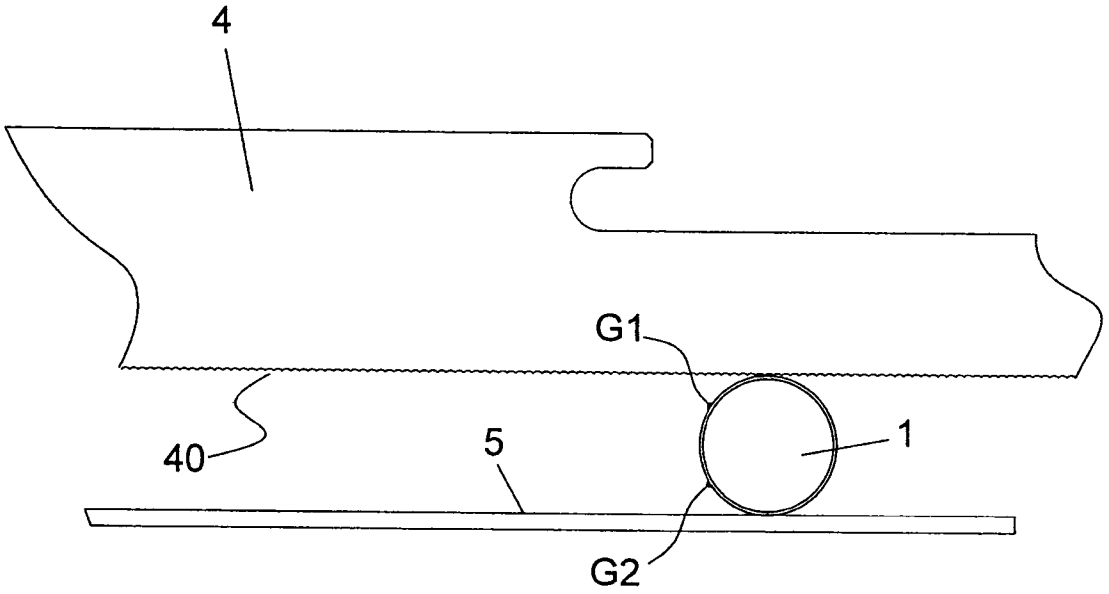
Figure 11:
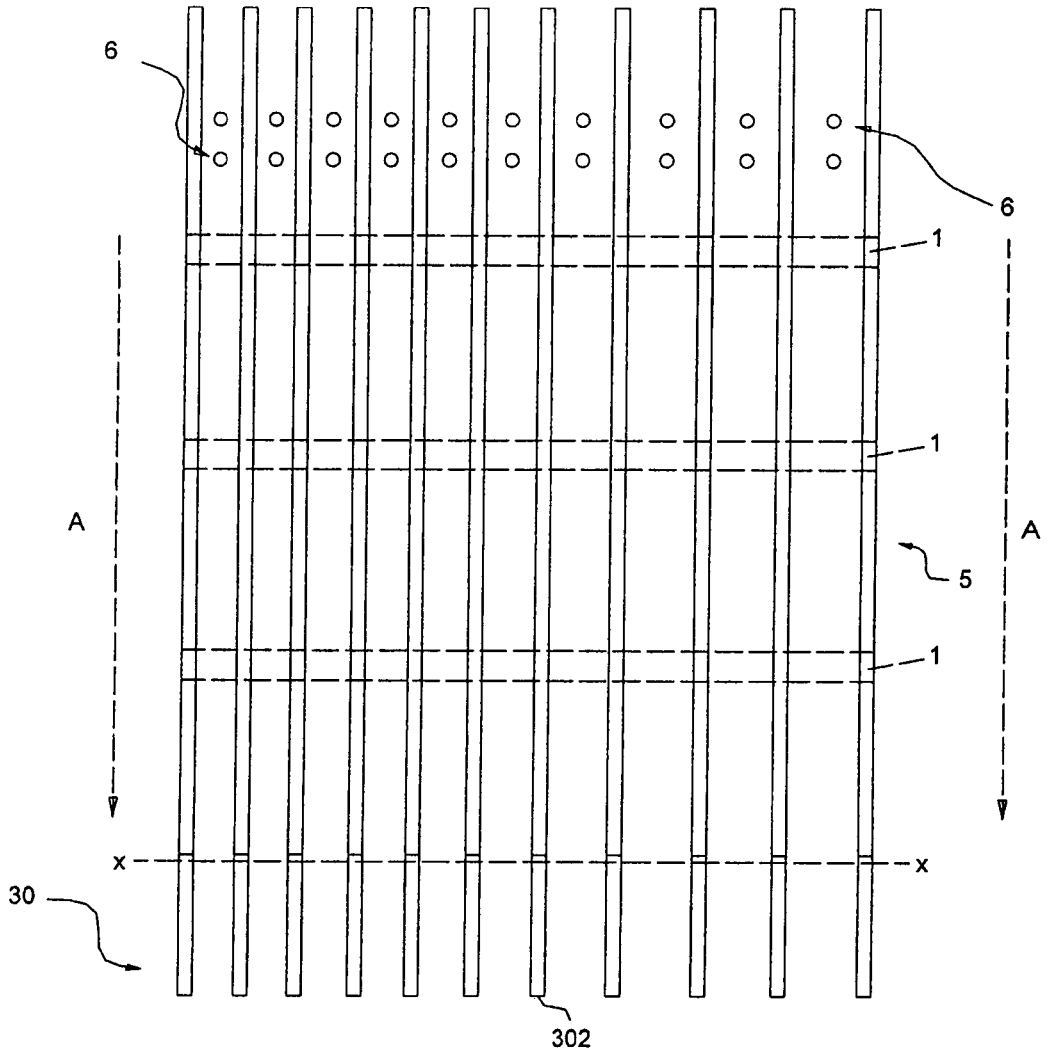
FIG. 11 is a schematic plan view from below of said path.

As shown in FIG. 9 and FIG. 12, the upper edge (303) of the plates (30), that is, the side of the cradle (3) facing the roller (R4), has an indentation. Similarly, as shown in FIG. 10, the lower edge (40) of the plates (4), that is, the side of the plates (4) facing the belts (5), has also an indentation. The function of these indentations is to produce a particularly high coefficient of friction where the same indentations are formed. In practice, in the guide (100) the indentation is provided on the upper side (formed by the bottom edge 40 of the plates 4). Similarly, in the cradle (3) the indentation is provided on the lower side (formed by the upper edge 303 of the plates 30). Still in other words, the path of the cores (1) is delimited by a fixed side (that in the guide part 100 is the lower edge 40 of the plates 4, while in the channel CH is the upper edge of the cradle 3, i.e. the upper edge of the plates 30) and an opposite movable side (that in the guide part 100 is formed by the top of the belts 5 while in the channel CH it is formed by the surface of the roller R4); and said fixed side (40, 303) has a surface structure adapted to prevent the slippage of the cores (1) on it while the same cores (1) roll on by effect of the traction exerted on them by said movable side. This feature of the path followed by the cores (1) implies a more precise guidance of the same as it avoids any possible slippage of the cores, or in any case the slippage of the cores is drastically reduced. Therefore, it is always possible to ensure the correct transfer of the glue (G1, G2) from the core to the first sheet of the new log to be formed and from the core the last sheet of the log in formation leading to a better quality finished product. The indentation represents a possible embodiment of surface structure of said fixed side of the path followed by the cores (1).

Alternatively, said fixed side can be knurled or it can be provided with a friction material coating or it can be coated with a high friction coefficient rubber.

Therefore, in accordance with this aspect of the invention, it is arranged a guide (100, 3) for the cores (1) having a fixed and a movable side intended for contact with the cores (1) and the fixed side of the guide has a surface structure adapted to prevent slippage of the cores (1) on it while the same roll cores by effect of a traction exerted by means of the movable side of the guide.

Where the guide has two different parts (eg, with reference to the examples described above, two disjoint sections) each of these sections has a fixed side and a movable side and the fixed side has the above-mentioned surface structure.

In practice the details of execution may vary in any equivalent manner as regards the individual elements described and illustrated without thereby departing from the scope of the adopted solution and thus remaining within the limits of the protection granted by the present patent.

The invention claimed is:

1. A rewinder for the production of logs, comprising feeding means adapted to supply a paper web, guide means adapted to guide sequentially several cores along a predetermined path between a station for feeding the cores and a winding station in which a predetermined amount of said web is wound on each core, winding means adapted to wind the paper web on the cores in the winding station, wherein said guide means comprise a guide with a curved end section that ends in the winding station and that, in cooperation with the winding means, delimits a channel crossed by each core before reaching the winding station, the rewinder comprising means adapted to cyclically modify the shape of the end section of the guide while the winding means carry out the winding of the web on the cores so that, cyclically, the height of a terminal part of the channel varies between a minimum predetermined value and a maximum predetermined value, wherein an end part of the curved end section of the guide is connected with an actuator that controls the movement thereof synchronously with the winding means such that said cyclic height variation is determined by the controlled movement of said end part of the curved end section moved by the actuator.

2. The rewinder according to claim 1, wherein the said height is measured in a radial direction with respect to a roller forming part of said winding means.

3. The rewinder according to claim 1, wherein said guide comprises a rectilinear section upstream of the curved end section.

4. The rewinder according to claim 1, wherein a rear part of the curved end section of said guide is connected to rotation means adapted to control its cyclic rotation around a horizontal axis, the angular amplitude of said rotation being predetermined, and said terminal curved part is formed by a plurality of elements each of which is connected to said rotation means through a respective rear part mounted on a driving shaft oriented along said axis.

5. The rewinder according to claim 1, wherein the end part of said curved end section is formed by moving extensions associated with fixed elements.

6. The rewinder according to claim 1, wherein said guide has a fixed side and a movable side intended for contact with the cores and the fixed side of the guide has a surface structure adapted to prevent slippage of the cores on it while the same cores roll by effect of a traction exerted by the movable side of the guide.

7. The rewinder according to claim 6, wherein said guide has two separate sections each of which has a fixed side and a movable side and the fixed side has the said surface structure.

* * * * *